US009087465B2

(12) United States Patent
Griffin et al.

(10) Patent No.: US 9,087,465 B2
(45) Date of Patent: Jul. 21, 2015

(54) ADAPTIVE PEDESTRIAN BILLBOARD SYSTEM AND RELATED METHODS

(75) Inventors: Jason T. Griffin, Kitchener (CA); Sherryl Lee Lorraine Scott, Toronto (CA)

(73) Assignee: BlackBerry Limited, Waterloo (CA)

( * ) Notice: Subject to any disclaimer, the term of this patent is extended or adjusted under 35 U.S.C. 154(b) by 1676 days.

(21) Appl. No.: 12/394,243

(22) Filed: Feb. 27, 2009

(65) Prior Publication Data

US 2010/0219973 A1 Sep. 2, 2010

(51) Int. Cl.
*G09F 27/00* (2006.01)
*G08G 1/005* (2006.01)

(52) U.S. Cl.
CPC ..... *G09F 27/00* (2013.01); *G08G 1/005* (2013.01)

(58) Field of Classification Search
None
See application file for complete search history.

(56) References Cited

U.S. PATENT DOCUMENTS

| | | | | |
|---|---|---|---|---|
| 5,696,502 | A * | 12/1997 | Busch et al. | 340/905 |
| 5,761,060 | A | 6/1998 | Drew | 364/146 |
| 6,414,650 | B1 | 7/2002 | Nicholson et al. | 345/55 |
| 6,587,755 | B1 * | 7/2003 | Smith et al. | 701/1 |
| 7,495,631 | B2 | 2/2009 | Bhakta et al. | |
| 2002/0032035 | A1 | 3/2002 | Teshima | 455/456 |
| 2002/0156667 | A1 | 10/2002 | Bergstrom | 705/7 |
| 2003/0096621 | A1 | 5/2003 | Jana et al. | |
| 2006/0089870 | A1 | 4/2006 | Myhr | 705/14 |
| 2007/0043500 | A1 * | 2/2007 | Chen | 701/117 |
| 2007/0257816 | A1 | 11/2007 | Lyle et al. | 340/905 |

OTHER PUBLICATIONS

LaFontaine, *Mobile Advertising: The Next Big Thing Hasn't Arrived (But it's on its Way)—Banners and 2D Codes*, Newspaper Association of America, Jul. 31, 2008, available at www.naa.org.

* cited by examiner

*Primary Examiner* — George Bugg
*Assistant Examiner* — Renee Dorsey
(74) *Attorney, Agent, or Firm* — Steven M. Greenberg, Esq.; Donna Flores, Esq.; CRGO Law

(57) ABSTRACT

An adaptive pedestrian billboard system may include a display for passing pedestrian traffic, and a memory for storing a plurality of notifications having different visual feature detail levels. The system may further include a controller configured to cooperate with the display and the memory for determining a density of the passing pedestrian traffic, select notifications from the memory based upon the density of the passing pedestrian traffic so that notifications for higher density passing pedestrian traffic have lower visual feature detail levels and so that notifications for lower density passing pedestrian traffic have higher visual feature detail levels, and display the selected notifications on the display.

21 Claims, 9 Drawing Sheets

ADAPTIVE PEDESTRIAN BILLBOARD SYSTEM AND RELATED METHODS

TECHNICAL FIELD

The present disclosure relates to the field of communications media, and, more particularly, to billboard systems and related methods.

BACKGROUND

Billboards are frequently positioned along roadsides or in public areas where pedestrian traffic is prominent. Traditional billboards include a message or image printed on a flexible PVC vinyl sheet (or recyclable plastic in some cases) which is stretched over the face of the advertising structure. Some smaller billboards are often referred to a "posters." Poster displays may include a series of printed paper sheets that are pasted together, or single sheet vinyl displays.

Due to advancements in computers and electronics, more sophisticated types of electronic billboards have become prevalent in recent years. One example is digital billboards, which use light emitting diodes (LEDs) or similar techniques to display dynamic messages or advertisements. For example, digital billboards allow static advertisements to be rotated in succession, as well as the ability to move, scroll, fade, etc., messages or advertisements, and even play video images. Another advanced form of billboard is the holographic billboard.

DETAILED DESCRIPTION

Figure 1:
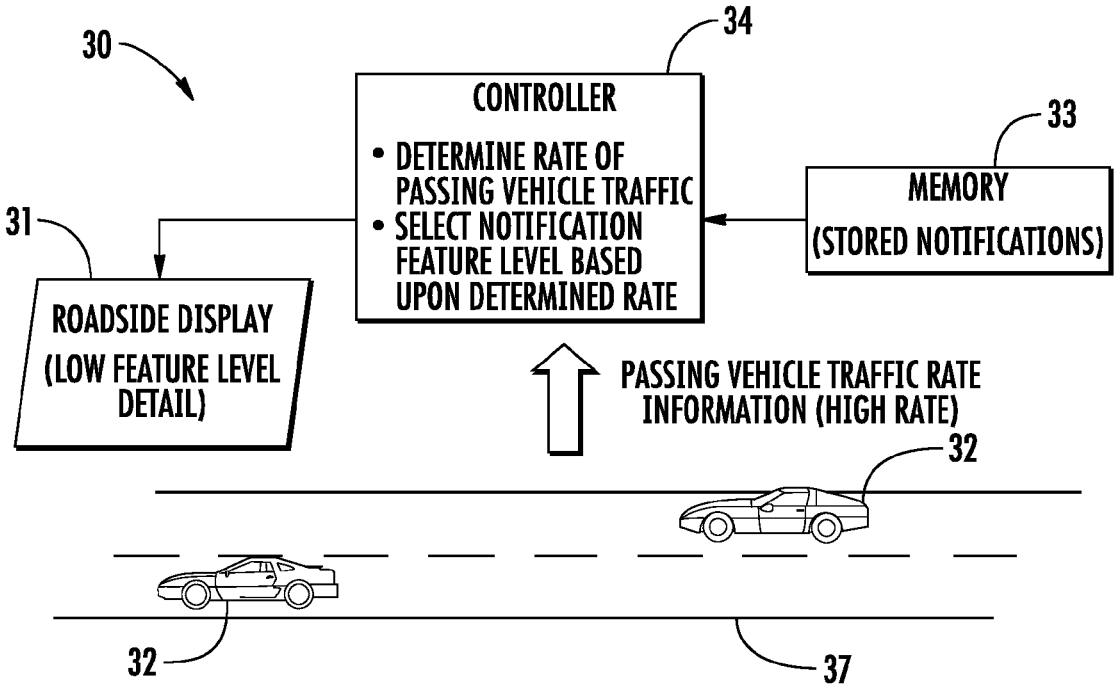
FIG. 1 is a schematic block diagram of an adaptive roadside billboard system in accordance with one exemplary embodiment shown during a period of faster passing vehicle traffic.

The present description is made with reference to the accompanying drawings, in which various embodiments are shown. However, many different embodiments may be used, and thus the description should not be construed as limited to the embodiments set forth herein. Rather, these embodiments are provided so that this disclosure will be thorough and complete. Like numbers refer to like elements throughout, and prime notation is used to indicate similar elements or steps in different embodiments.

Generally speaking, an adaptive pedestrian billboard system is disclosed herein which may include a display for passing pedestrian traffic, and a memory for storing a plurality of notifications having different visual feature detail levels. The system may further include a controller configured to cooperate with the display and the memory to determine a density of the passing pedestrian traffic, select notifications from the memory based upon the density of the passing pedestrian traffic so that notifications for higher density passing pedestrian traffic have lower visual feature detail levels and so that notifications for lower density passing pedestrian traffic have higher visual feature detail levels, and display the selected notifications on the display.

More particularly, the different visual feature detail levels may be based upon different densities of alphanumeric characters. The different visual feature detail levels may also be based upon different sizes of alphanumeric characters or different image detail levels, or both. Furthermore, the controller may further cooperate with the display to change a relative position of notifications based upon the density of the passing pedestrian traffic. By way of example, the notifications may include video images or static images, or both.

The adaptive pedestrian billboard system may also include at least one sensor in proximity to the display. As such, the controller may cooperate with the at least one sensor to determine the density of passing pedestrian traffic. The controller may also determine the density of passing pedestrian traffic based upon position information collected from mobile wireless communications devices of the pedestrians. In some embodiments, the memory and the controller may be collocated with the display.

The adaptive pedestrian billboard system may also include at least one speaker collocated with the display and cooperating with the controller for generating audio output for the notifications. As such, the controller may also change a volume level of the audio output based upon the density of the passing pedestrian traffic. By way of example, the notifications may include advertisements.

A related method for displaying notifications on a display for passing pedestrian traffic may include storing a plurality of notifications having different visual feature detail levels in a memory, and determining a density of the passing pedestrian traffic. The method may further include selecting notifications from the memory based upon the density of the passing pedestrian traffic so that notifications for higher density passing pedestrian traffic have lower feature detail levels and so that notifications for lower visual density passing pedestrian traffic have higher visual feature detail levels, and displaying the selected notifications on the display.

Referring initially to FIGS. 1 through 6, an adaptive roadside billboard system 30 and associated methods are first described. The system 30 illustratively includes a roadside display 31 for passing vehicle 32 traffic on a road 37, and a memory 33. The roadside display 31 may be a digital billboard display, such as those discussed above (e.g., LED, holographic, etc.). Beginning at Block 60, the memory 33 is for storing a plurality of notifications having different visual feature detail levels, at Block 61. By way of example, the notifications may include advertisements, motorist advisories (e.g., for accidents, road conditions, etc.), or other types of information that is desirable to display to motorists, as will be appreciated by those skilled in the art.

The different visual feature detail levels of the notifications may be based upon various characteristics. For example, different notifications may have different densities of alphanumeric characters (i.e., letters or numbers, or both). Furthermore, different notifications may have different sizes of alphanumeric characters. Still another detail level of notifications in some embodiments may be different image detail levels, such as the resolution of images to be included within a notification or the amount of features presented in the image, for example.

Figure 5:
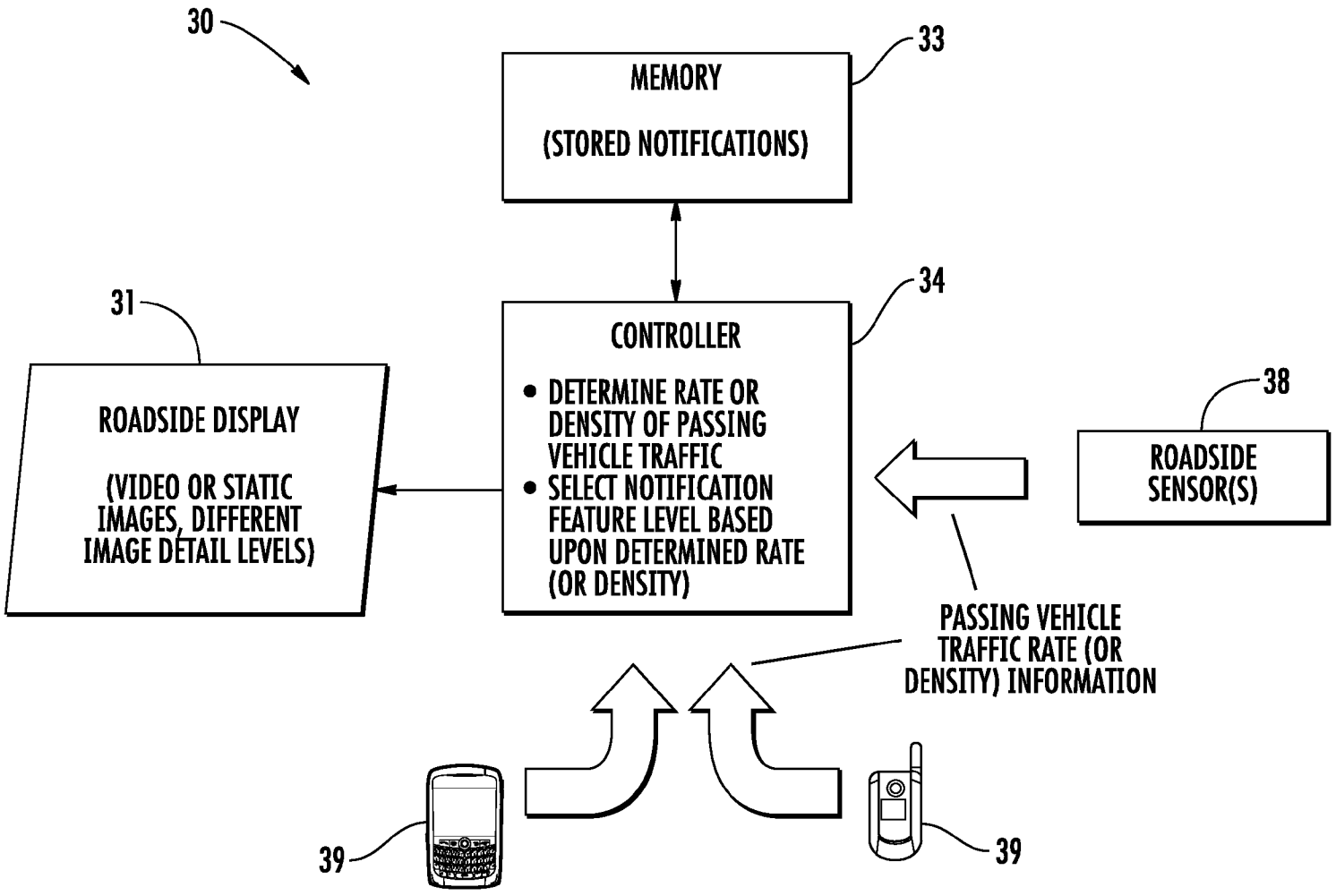
FIG. 5 is a schematic block diagram of the system of FIG. 1 illustrating passing vehicle traffic rate information collection techniques.
Figure 6:
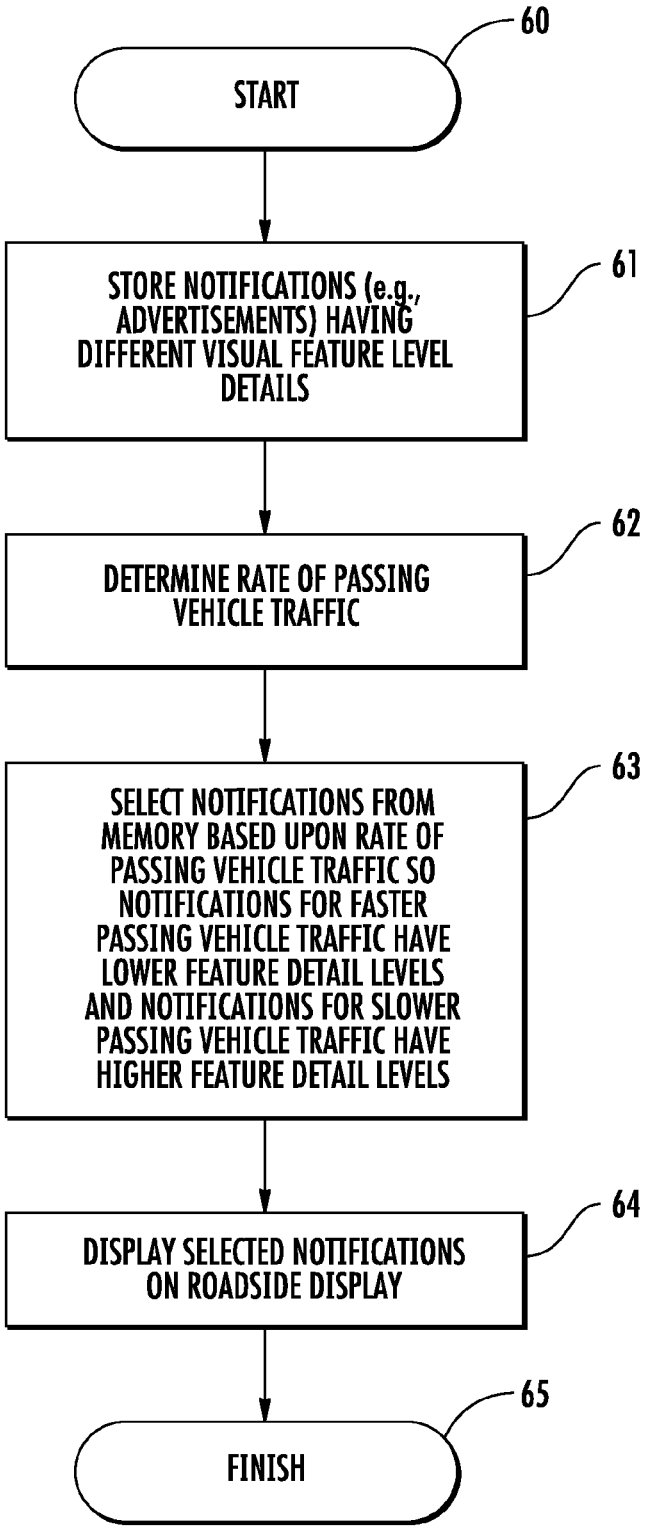
FIG. 6 is a flow diagram illustrating a method for displaying notifications on a roadside display for passing vehicle traffic in accordance with an exemplary embodiment.

In some embodiments, the notifications may include video images or static images, or both (see FIG. 5). Generally speaking, a video image is considered herein as having a higher visual feature level detail than a comparable static image because video images include a series of images rather than a single image. However, in some implementations a static image may be considered to have a relatively high feature level as well, such as if it is a high resolution or high feature level image, as noted above.

Other information that may be included in the notifications include common short codes (CSCs) and quick response (QR) codes, for example. As will be appreciated by those skilled in the art, CSCs are a short series of number (e.g., 5 or 6 digits), to which a user may send a text message that will trigger a response message from an advertiser with additional information, coupons, special offers, etc. QR codes are graphical patterns that may be read by cellular phones with that include or represent a string of unique numbers, which cause the phone's browser to launch and redirect to a URL included in the QR code. In one embodiment, such additional codes may be included as additional feature level detail when the rate of passing traffic decreases (or traffic density increases), meaning that those passing by will have more time to view and interact with this additional information, as will be discussed further below.

The system 30 also illustratively includes a controller 34 for cooperating with the roadside display 31 and the memory 33 for determining a rate of the passing vehicle 32 traffic (Block 62), selecting notifications from the memory based upon the rate of passing vehicle traffic so that notifications for faster passing vehicle traffic have lower feature detail levels and so that notifications for slower passing vehicle traffic have higher feature detail levels, at Block 63, and displaying the selected notifications on the roadside display, at Block 64, thus concluding the illustrated method (Block 65). In the example of FIG. 1, the vehicle 32 traffic is moving relatively fast. In other words, it may be said that the traffic is "up to speed," meaning that the traffic is moving at or near the posted speed limit for the road 37. In such case, the vehicles 32 are traveling faster (i.e., at a higher rate), so drivers will typically have less time to look at roadside billboards because they will be passing the billboards faster (and are therefore in view of the billboard for a shorter duration).

As such, when traffic is moving at a relatively fast pace the controller 34 selects notifications with lower feature detail levels so that motorists are able to take in the information presented on the roadside display 31. Referring to the example of FIG. 2, here an advertisement for the "Road House Restaurant" is displayed, along with a reduced set of information for motorists. That is, the display 31 indicates that the restaurant is open for breakfast, lunch, and dinner, and that the restaurant is located off of Exit 91. In other words, the amount of information presented on the display 31 is advantageously kept relatively small to include only the most pertinent details for motorists, since the motorists are unable to view and mentally process large amounts of visual data from a sign at higher rates of speed, as will be appreciated by those of skill in the art.

Figure 3:
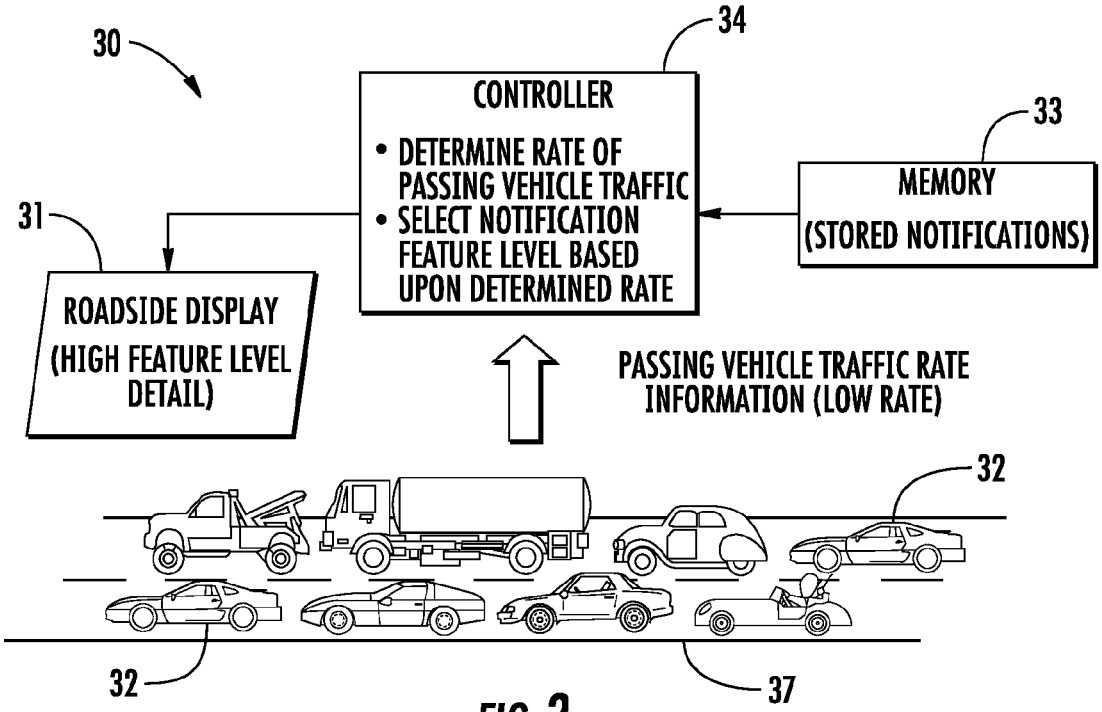
FIG. 3 is a schematic block diagram of the adaptive roadside billboard system of FIG. 1 shown during a period of slower passing vehicle traffic.
Figure 4:
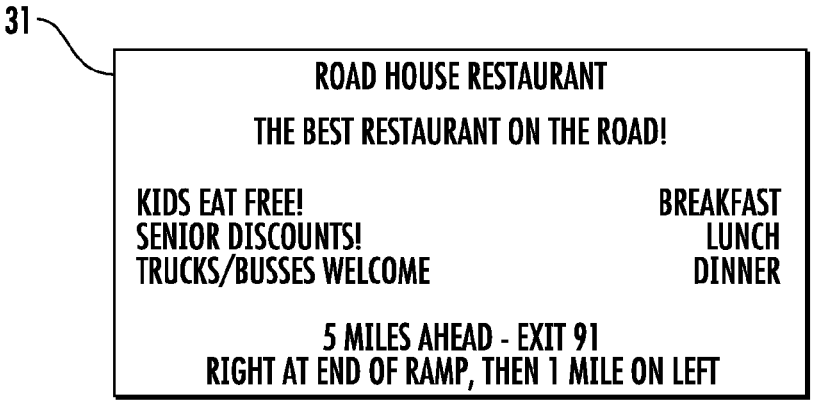
FIG. 4 is a front view of the roadside display of the system of FIG. 3 with a notification displayed thereon based upon the slower passing vehicle traffic.

However, as traffic slows, motorists will be in view of the roadside display 31 for longer periods of time. This is especially the case during rush hour traffic or when there is an accident, etc., on the road 37 that causes traffic to temporarily come to a stop, i.e., "stop-and-go" or "bumper-to-bumper" traffic, as is illustrated in FIG. 3. Accordingly, motorists are now able to view and mentally process much greater levels of visual detail from the display 31. In such case, the controller 34 advantageously causes the roadside display 31 to display an advertisement with a higher visual feature level detail, as seen in FIG. 4. Here, not only is the name of the Road House Restaurant displayed along with the exit number and "breakfast, lunch, dinner" information as in FIG. 2, but additional details are provided as well. In the illustrated example, the addition details include notices that kids eat free, senior discounts are offered, and that trucks/busses are welcome. Moreover, additional direction information is provided, including the distance to the upcoming exit, and directions on which way to turn and how far to travel after taking the exit. Various other types of notification information and configurations may be used in different embodiments, as will be appreciated by those skilled in the art.

Figure 2:
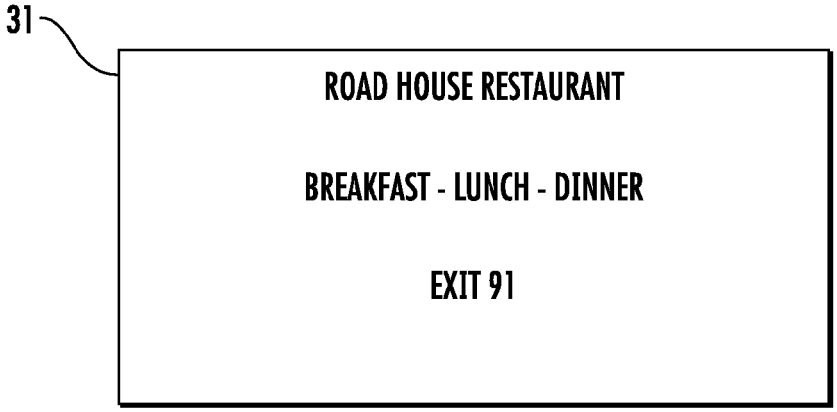
FIG. 2 is a front view of the roadside display of the system of FIG. 1 with a notification displayed thereon based upon the faster passing vehicle traffic.

From the examples of FIGS. 2 and 4 it will be appreciated that in some embodiments a same advertiser may utilize different advertisements for different vehicle traffic rates. That is, an advertiser advertises during periods of fast and slow traffic, but uses different advertisements tailored accordingly. However, this need not be the case in all embodiments. That is, some advertisers may prefer to only advertise when traffic is moving slowly so that they can provide more detailed advertisements to motorists, and therefore do not pay to display advertisements during periods when vehicles 32 are moving relatively fast. In some implementations, advertisement prices may be adjusted based upon the time during which advertisements are displayed, such as being more expensive when traffic rates are slower (i.e., usually indicating there is more traffic adjacent the display 31). Thus, some advertisers may chose to run advertisements during periods when advertisements are less costly to display, e.g., when vehicles are moving faster.

Various approaches may be used to determine the rate of the passing vehicle 32 traffic. In accordance with one exemplary embodiment, one or more roadside velocity sensors 38 may be positioned along the road 37 in proximity to the roadside display 31. By way of example, the velocity sensors could be roadside cameras, radio frequency (RF) sensors that detect RF signals from transmitters in passing vehicles 32, pressure sensors, etc., as will be appreciated by those skilled in the art. The sensors may be positioned at various points along the road 37, such as within a few miles of the display 31, for example, although other distances are also possible. The controller 33 may also determine the rate of passing vehicle 32 traffic based upon position information collected from the vehicles. For example, the rate information could be collected from mobile wireless communications devices with satellite positioning capabilities (e.g., global positioning system (GPS)), such as cellular telephones, vehicle navigation devices, etc., carried within the vehicles 32.

In some embodiments, traffic density may be used in addition to, or instead of, the traffic rate information to determine the appropriate notifications for the display 31. For example, where the controller 34 also determines passing vehicle traffic density, the controller may select notifications from the memory 33 based upon the rate and density of passing vehicle traffic so that notifications for faster passing vehicle traffic with higher densities have lower visual feature detail levels, and so that notifications for faster passing vehicle traffic with lower densities have higher visual feature detail levels. More particularly, if traffic is moving fast but is relatively dense, this means that the cars are closer to one another. As a result, drivers may be more cautious in such situations and more focused straight ahead, meaning that they generally will not divert their attention to the display 31 for very long for safety reasons. Thus, notifications with less visual feature level detail are more appropriate in this scenario.

The traffic density information may be determined using the same approaches discussed above for determining vehicle rate (i.e., roadside sensors 38, wireless communications devices 39, etc.). However, in some embodiments it is possible that roadside sensors or satellite positioning units are not available for communication with the controller 34. In such embodiments, the density may be used instead of the traffic rate, or to estimate the traffic rate. Generally speaking, traffic rate or speed is proportional to traffic density in most scenarios, meaning that slower moving traffic is more dense, and faster moving traffic is less dense, although this is not always the case, as discussed above.

Thus, where traffic rates cannot be accurately determined, notifications may be selected such that more dense traffic results in notifications with higher visual feature level detail, and lower density traffic results in notifications with lower visual feature level detail. In such instances, the density of vehicles could be determined based upon a number of cellular devices communicating with a cellular tower in the vicinity of the display 31, for example, although other density determining approaches may also be used. The day of the week and time of day may also be factored into the density or rate determination analysis. For example, if using density data to estimate the passing vehicle traffic rate, the day or time, or both, may be used to further check or refine the determination, such as if it is rush hour on a weekday, as will be appreciated by those skilled in the art.

In some embodiments, the memory 33 and the controller 34 may be collocated with the roadside display 31, although this need not be the case in all embodiments. That is, the controller 34 or memory 33, or both, could be remotely located from the display 31 and connected thereto via a wireless (e.g., cellular) or wide area network link, for example, although other communications approaches may also be used, as will be appreciated by those skilled in the art. The controller 34 may be implemented using one or more computing devices and associated software applications, as well as discrete circuitry, as will be appreciated by those skilled in the art. The various functions of the controller 34 described herein may be distributed across multiple computing platforms, or they may be performed by a single computing device.

Turning now to FIGS. 7-12, a related adaptive billboard system 30' and method are for pedestrians 70'. In the illustrated embodiment, the system 30' includes a display 31' for passing pedestrian traffic, and a memory 33' for storing a plurality of notifications having different visual feature detail levels, as similarly discussed above (Blocks 60'-61'). Also, a controller 34' is again included for cooperating with the display 31' and the memory 33' is for determining a density of the passing pedestrian traffic, at Block 62'. Here, the controller 34' selects notifications from the memory 33' based upon the density of the passing pedestrian traffic so that notifications for higher density passing pedestrian traffic have lower feature detail levels and so that notifications for lower density passing pedestrian traffic have higher feature detail levels, at Block 63'. The controller 34' then displays the selected notifications on the display 31', at Block 64', thus concluding the illustrated method of FIG. 12 (Block 65').

Figure 7:
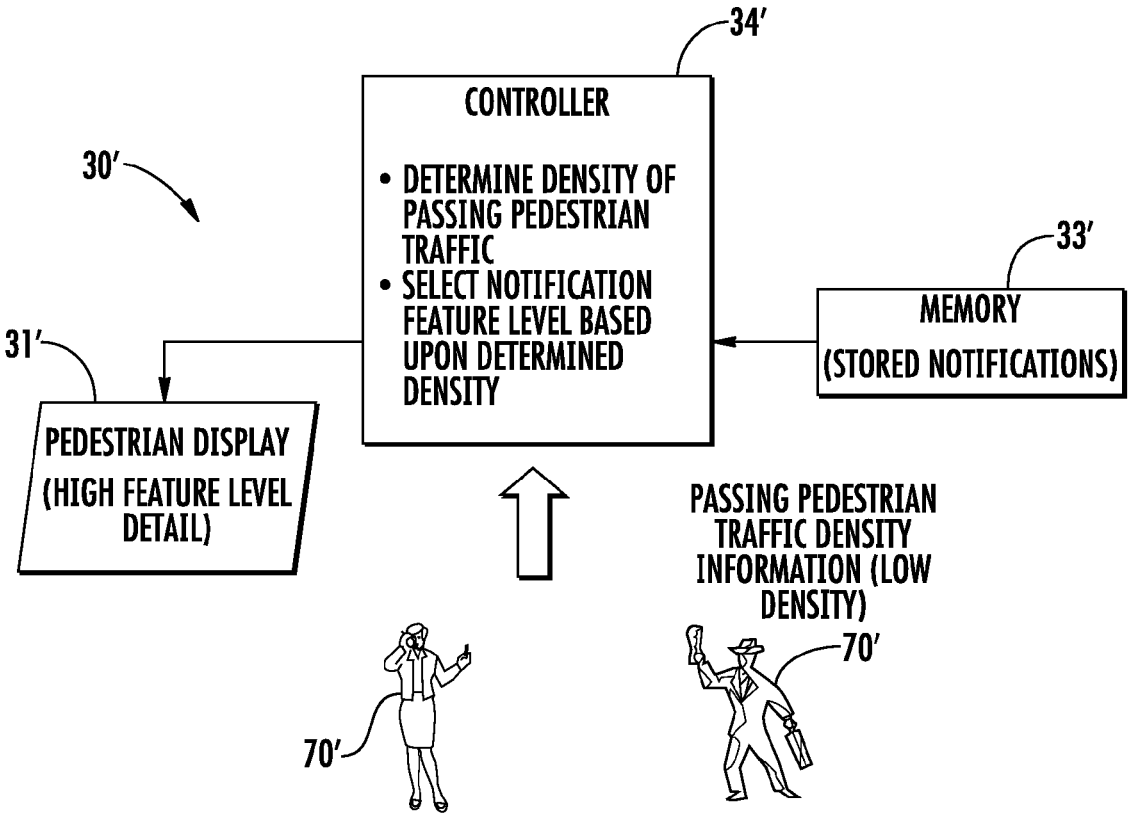
FIG. 7 is a schematic block diagram of an adaptive pedestrian billboard system in accordance with one exemplary embodiment shown during a period of lower density passing pedestrian traffic.
Figure 8:
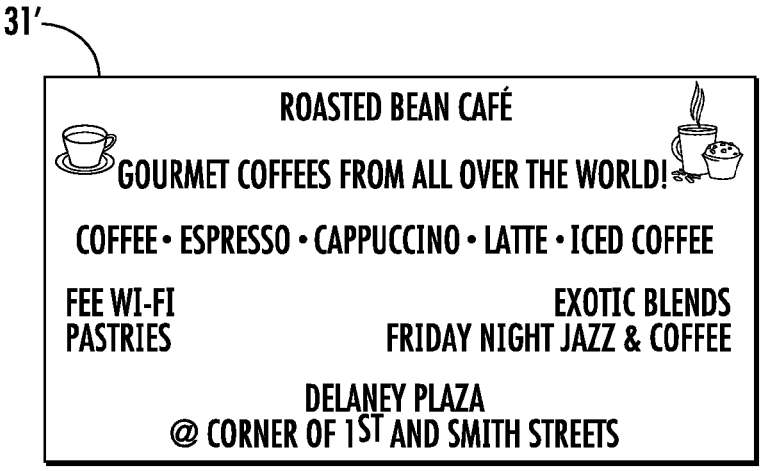
FIG. 8 is a front view of the pedestrian display of the system of FIG. 7 with a notification displayed thereon based upon the lower density passing pedestrian traffic.

Generally speaking, the more pedestrians 70' there are in view of the display 31', the more distraction there will be. That is, with larger crowds, people are generally less likely to pay attention to billboards and advertisements (i.e., their attention may be divided among more visual stimuli). Accordingly, notifications such as advertisements with more words and smaller character size may generally be more appropriate for smaller crowds where pedestrians 70' may pay more attention, and have more opportunity to view and mentally process all of the information provided on the display 31'. In the example of FIG. 8, an advertisement for the "Roasted Bean Café is displayed on the display 31' during a period of low pedestrian traffic density (FIG. 7). The display 31' therefore also includes a significant amount of additional detail, including: a slogan "gourmet coffees from all over the world"; a list of coffee drinks served; a notice that free wireless access (Wi-Fi) is provided; a notice that pastries are served; notice that exotic blends of coffees are available; a notice that there is a Friday night jazz and coffee time; and the location and intersection of the store is also provided.

Figure 9:
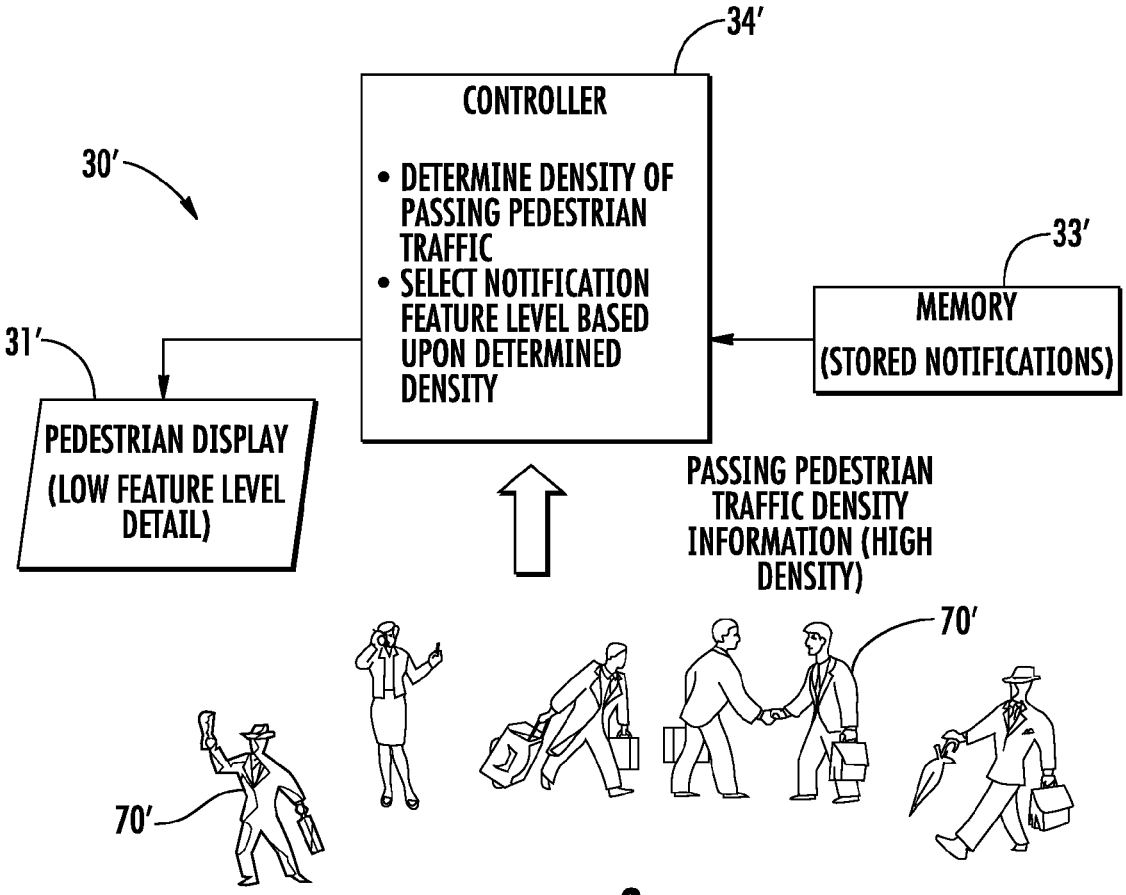
FIG. 9 is a schematic block diagram of the adaptive pedestrian billboard system of FIG. 7 shown during a period of higher density passing pedestrian traffic.
Figure 10:
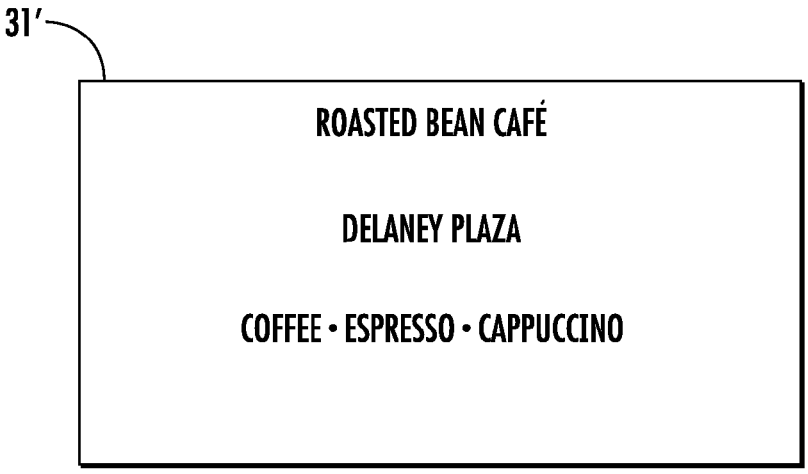
FIG. 10 is a front view of the pedestrian display of the system of FIG. 9 with a notification displayed thereon based upon the higher density passing pedestrian traffic.

In the example of FIGS. 9 and 10, however, the density of pedestrians 70' passing the display 31' is greater than in the prior example, meaning the area around the display is more "busy," and thus the amount of detail provided on the display is decreased. In this example, only the name of the café, its location, and an abbreviated list of the most popular coffee drinks is provided. That is, the advertisement on the display 31' includes less alphanumeric characters, and the size of the characters is also increased, particularly the name. Moreover, image detail levels have been changed between the example of FIGS. 8 and 10, namely the coffee and pastry images shown in FIG. 8 are not present in FIG. 10.

As discussed above, video and static images may also be used depending upon the passing pedestrian 70' density. For example, during the middle of the day when less pedestrians 70' are around the display 31', notification with videos and text streams may be used, whereas later in the day when more pedestrians are around static images may be displayed for relatively long periods of time. Other configurations are also possible, as will be appreciated by those skilled in the art.

Another advantageous feature is that the controller 34' may further cooperate with the display 31' to change a relative position of notifications on the display based upon the density of the passing pedestrian traffic. For example, as the area around the pedestrian display 31' gets more crowded (i.e., the density increases), it may become more difficult for pedestrians 70' farther away from the display to see lower portions thereof, and it may therefore be desirable to display less information toward the bottom of the display. In the example of FIG. 10, the location of the café (i.e., "Delaney Plaza") has been moved up on the display 31' toward the top, so that this important information is less likely to be missed by passing pedestrians that may be at a significant distance from the display.

As with the adaptive roadside billboard system 30 discussed above, the pedestrian billboard system 30' may also include one or more sensors 38' (e.g., cameras, motion sensors, etc.) in proximity to the display 31' with which the controller 34' cooperates to determine the density of passing pedestrian traffic. This determination may also be made based upon position information collected from mobile wireless communications devices 39' of the pedestrians, as will be appreciated by those skilled in the art. Again, it should be noted that in some embodiments, the memory 33' and the controller 34' may be collocated with the display 31', but this need not be the case in all embodiments.

Figure 11:
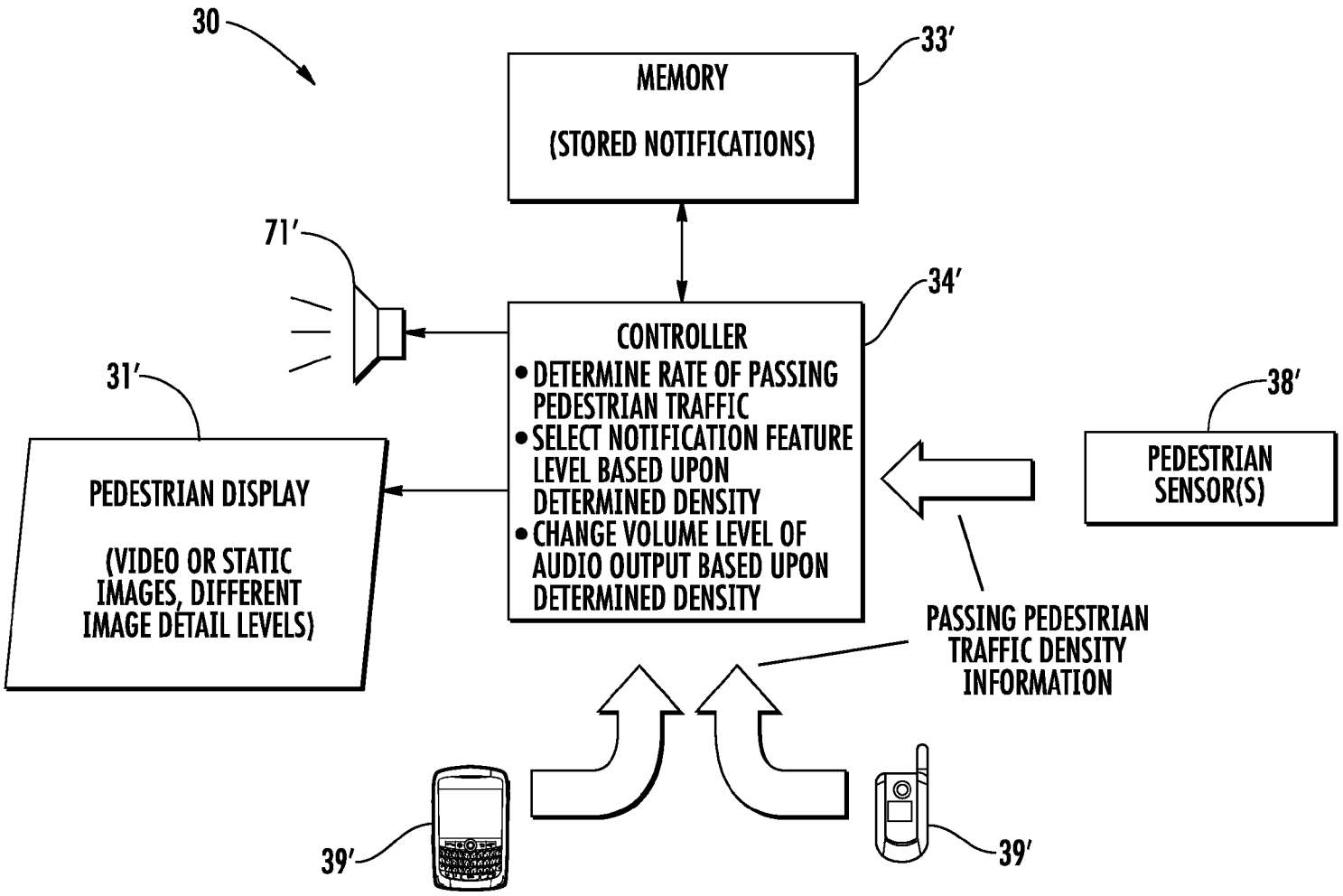
FIG. 11 is a schematic block diagram of the system of FIG. 7 illustrating passing pedestrian traffic density information collection techniques.
Figure 12:
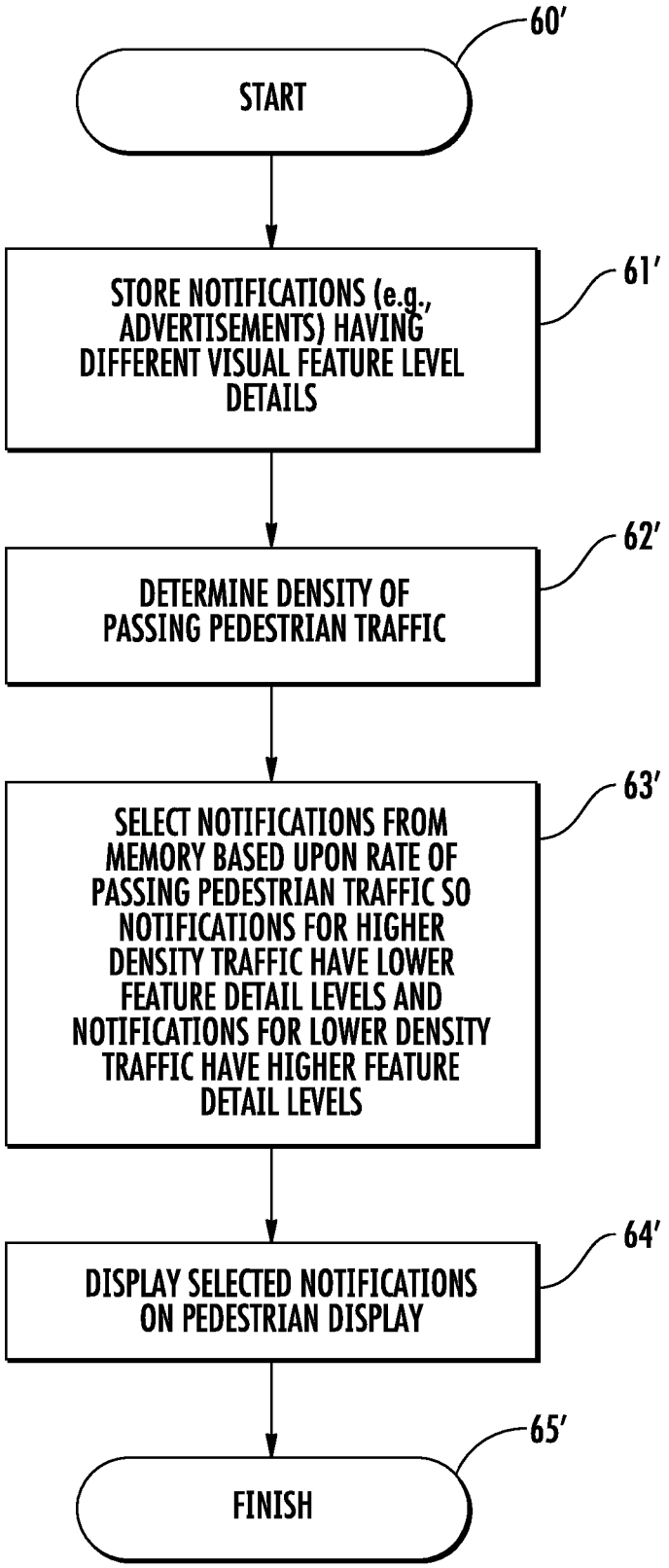
FIG. 12 is a flow diagram illustrating a method for displaying notifications on a pedestrian display for passing pedestrian traffic in accordance with an exemplary embodiment.

In the example of FIG. 11, the system 30' also illustratively includes one or more speakers 71' collocated with the display 31' and cooperating with the controller 34' for generating audio output for the notifications, such as spoken text, music, etc. As such, the controller 34' may also change a volume level of the audio output based upon the density of the passing pedestrian traffic. For example, the volume may be increased as the crowd size (i.e., density) increases so that the audio output can be heard over the crowd noise, and vice-versa. Moreover, in some applications an audio sensor (e.g., microphone) may be used in cooperation with the controller 34' to measure a noise level from the crowd and adjust the volume level of the audio output appropriately, as will be appreciated by those skilled in the art.

Exemplary components of a hand-held mobile wireless communications device 1000 that may be used in accordance with the systems 30, 31', such as for determining traffic rate or density, or both, are further described in the example below with reference to FIG. 13. The device 1000 illustratively includes a housing 1200, a keypad 1400 and an output device 1600. The output device shown is a display 1600, which may comprise a full graphic LCD. In some embodiments, display 1600 may comprise a touch-sensitive input and output device. Other types of output devices may alternatively be utilized. A processing device 1800 is contained within the housing 1200 and is coupled between the keypad 1400 and the display 1600. The processing device 1800 controls the operation of the display 1600, as well as the overall operation of the mobile device 1000, in response to actuation of keys on the keypad 1400 by the user. In some embodiments, keypad 1400 may comprise a physical keypad or a virtual keypad (e.g., using a touch-sensitive interface) or both.

The housing 1200 may be elongated vertically, or may take on other sizes and shapes (including clamshell housing structures). The keypad 1400 may include a mode selection key, or other hardware or software for switching between text entry and telephony entry.

Figure 13:
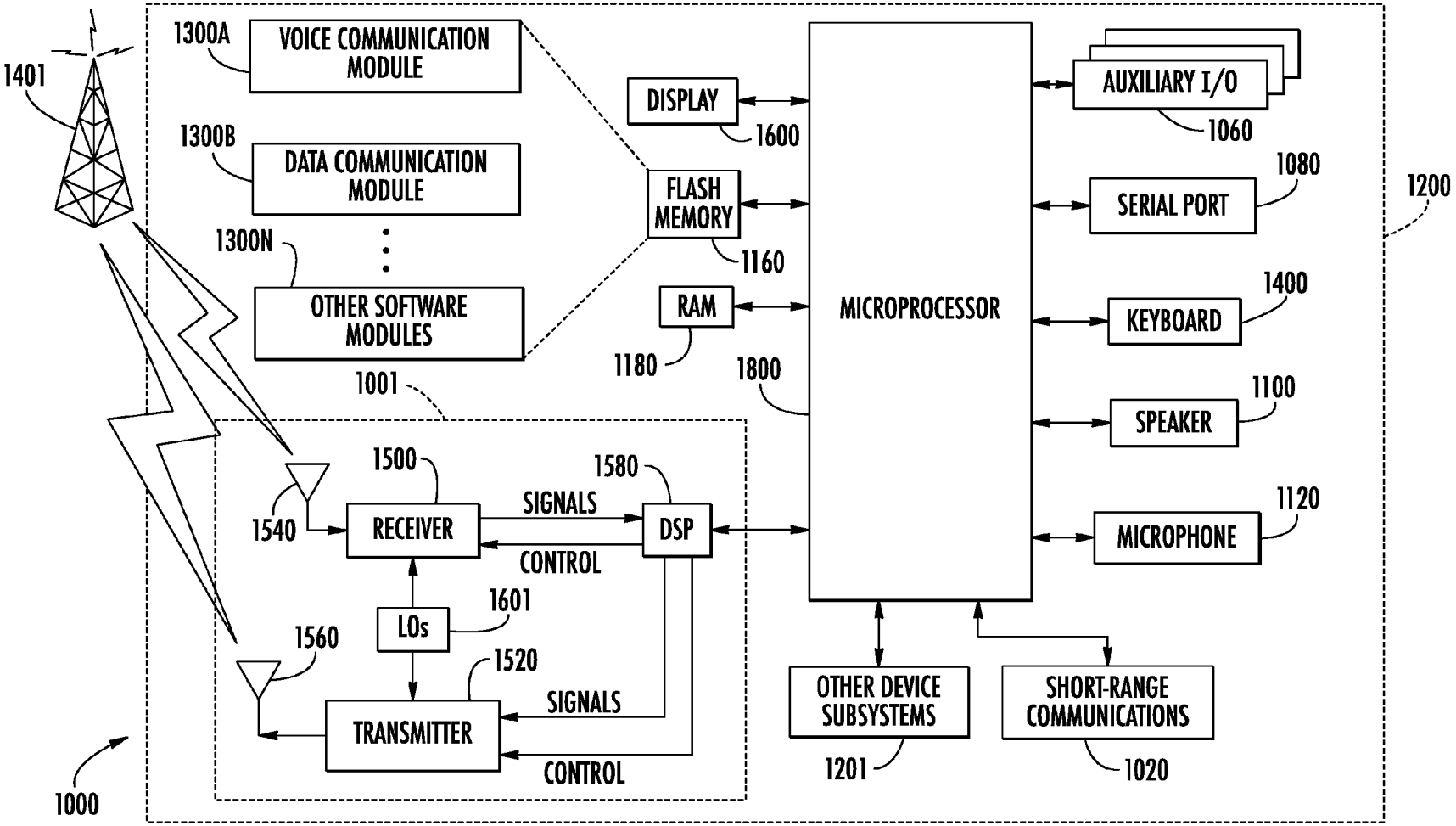
FIG. 13 is a schematic block diagram illustrating exemplary components of a mobile wireless communications device that may be used for determining vehicle traffic rate or density, or passing pedestrian traffic density, in accordance with exemplary embodiments.

In addition to the processing device 1800, other parts of the mobile device 1000 are shown schematically in FIG. 13. These include a communications subsystem 1001; a short-range communications subsystem 1020; the keypad 1400 and the display 1600, along with other input/output devices 1060, 1080, 1100 and 1120; as well as memory devices 1160, 1180 and various other device subsystems 1201. The mobile device 1000 may comprise a two-way RF communications device having voice and data communications capabilities. In addition, the mobile device 1000 may have the capability to communicate with other computer systems via the Internet.

Operating system software executed by the processing device 1800 may be stored in a persistent store, such as the flash memory 1160, but may be stored in other types of memory devices, such as a read only memory (ROM) or similar storage element. In addition, system software, specific device applications, or parts thereof, may be temporarily loaded into a volatile store, such as the random access memory (RAM) 1180. Communications signals received by the mobile device may also be stored in the RAM 1180.

The processing device 1800, in addition to its operating system functions, enables execution of software applications 1300A-1300N on the device 1000. A predetermined set of applications that control basic device operations, such as data and voice communications 1300A and 1300B, may be installed on the device 1000 during manufacture. In addition, a personal information manager (PIM) application may be installed during-manufacture. The PIM may be capable of organizing and managing data items, such as e-mail, calendar events, voice mails, appointments, and task items. The PIM application may also be capable of sending and receiving data items via a wireless network 1401. The PIM data items may be seamlessly integrated, synchronized and updated via the wireless network 1401 with the device user's corresponding data items stored or associated with a host computer system.

Communication functions, including data and voice communications, are performed through the communications subsystem 1001, and possibly through the short-range communications subsystem. The communications subsystem 1001 includes a receiver 1500, a transmitter 1520, and one or more antennas 1540 and 1560. In addition, the communications subsystem 1001 also includes a processing module, such as a digital signal processor (DSP) 1580, and local oscillators (LOs) 1601. The specific design and implementation of the communications subsystem 1001 is dependent upon the communications network in which the mobile device 1000 is intended to operate. For example, a mobile device 1000 may include a communications subsystem 1001 designed to operate with the Mobitex™, Data TAC™ or General Packet Radio Service (GPRS) mobile data communications networks, and also designed to operate with any of a variety of voice communications networks, such as AMPS, TDMA, CDMA, WCDMA, PCS, GSM, EDGE, etc. Other types of data and voice networks, both separate and integrated, may also be utilized with the mobile device 1000. The mobile device 1000 may also be compliant with other communications standards such as 3GSM, 3G, UMTS, 4G, etc.

Network access requirements vary depending upon the type of communication system. For example, in the Mobitex and DataTAC networks, mobile devices are registered on the network using a unique personal identification number or PIN associated with each device. In GPRS networks, however, network access is associated with a subscriber or user of a device. A GPRS device therefore utilizes a subscriber identity module, commonly referred to as a SIM card, in order to operate on a GPRS network.

When required network registration or activation procedures have been completed, the mobile device 1000 may send and receive communications signals over the communication network 1401. Signals received from the communications network 1401 by the antenna 1540 are routed to the receiver 1500, which provides for signal amplification, frequency down conversion, filtering, channel selection, etc., and may also provide analog to digital conversion. Analog-to-digital conversion of the received signal allows the DSP 1580 to perform more complex communications functions, such as demodulation and decoding. In a similar manner, signals to be transmitted to the network 1401 are processed (e.g. modulated and encoded) by the DSP 1580 and are then provided to the transmitter 1520 for digital to analog conversion, frequency up conversion, filtering, amplification and transmission to the communication network 1401 (or networks) via the antenna 1560.

In addition to processing communications signals, the DSP 1580 provides for control of the receiver 1500 and the transmitter 1520. For example, gains applied to communications signals in the receiver 1500 and transmitter 1520 may be adaptively controlled through automatic gain control algorithms implemented in the DSP 1580.

In a data communications mode, a received signal, such as a text message or web page download, is processed by the communications subsystem 1001 and is input to the processing device 1800. The received signal is then further processed by the processing device 1800 for an output to the display 1600, or alternatively to some other auxiliary I/O device 1060. A device user may also compose data items, such as e-mail messages, using the keypad 1400 and/or some other auxiliary I/O device 1060, such as a touchpad, a rocker switch, a thumb-wheel, track ball, or some other type of input device. The composed data items may then be transmitted over the communications network 1401 via the communications subsystem 1001.

In a voice communications mode, overall operation of the device is substantially similar to the data communications mode, except that received signals are output to a speaker 1100, and signals for transmission are generated by a microphone 1120. Alternative voice or audio I/O subsystems, such as a voice message recording subsystem, may also be implemented on the device 1000. In addition, the display 1600 may also be utilized in voice communications mode, for example to display the identity of a calling party, the duration of a voice call, or other voice call related information.

The short-range communications subsystem enables communication between the mobile device 1000 and other proximate systems or devices, which need not necessarily be similar devices. For example, the short-range communications subsystem may include an infrared device and associated circuits and components, or a Bluetooth™ communications module to provide for communication with similarly-enabled systems and devices.

Many modifications and other embodiments will come to the mind of one skilled in the art having the benefit of the teachings presented in the foregoing descriptions and the associated drawings. Therefore, it is understood that various modifications and embodiments are intended to be included within the scope of the appended claims.

That which is claimed is:

1. An adaptive pedestrian billboard system comprising:
a display for passing pedestrian traffic;
a memory for storing a plurality of notifications having different visual feature detail levels; and
a controller configured to cooperate with said display and said memory to
determine a density of the passing pedestrian traffic based upon position information collected from mobile wireless communications devices of the pedestrians,
select notifications from said memory based upon the density of the passing pedestrian traffic so that notifications for higher density passing pedestrian traffic have lower visual feature detail levels and so that notifications for lower visual density passing pedestrian traffic have higher visual feature detail levels, and
display the selected notifications on said display.

2. The adaptive pedestrian billboard system of claim 1 wherein the different visual feature detail levels are based upon different densities of alphanumeric characters.

3. The adaptive pedestrian billboard system of claim 1 wherein the different visual feature detail levels are based upon different sizes of alphanumeric characters.

4. The adaptive pedestrian billboard system of claim 1 wherein the different visual feature detail levels are based upon different image detail levels.

5. The adaptive pedestrian billboard system of claim 1 wherein said controller further cooperates with said display to change a relative position of notifications based upon the density of the passing pedestrian traffic.

6. The adaptive pedestrian billboard system of claim 1 wherein the notifications comprise at least one of video images and static images.

7. The adaptive pedestrian billboard system of claim 1 further comprising at least one sensor in proximity to said display; and wherein said controller cooperates with said at least one sensor to determine the density of passing pedestrian traffic.

8. The adaptive pedestrian billboard system of claim 1 wherein said memory and said controller are collocated with said display.

9. The adaptive pedestrian billboard system of claim 1 further comprising at least one speaker collocated with said display and cooperating with said controller for generating audio output for the notifications; and wherein said controller also changes a volume level of the audio output based upon the density of the passing pedestrian traffic.

10. The adaptive pedestrian billboard system of claim 1 wherein the notifications comprise advertisements.

11. An adaptive pedestrian billboard system comprising:
a display for passing pedestrian traffic;
a memory for storing a plurality of notifications having different visual feature detail levels based upon at least one of different densities and sizes of alphanumeric characters; and
a controller configured to cooperate with said display and said memory to
determine a density of the passing pedestrian traffic based upon position information collected from mobile wireless communications devices of the pedestrians,
select notifications from said memory based upon the density of the passing pedestrian traffic so that notifications for higher density passing pedestrian traffic have lower visual feature detail levels and so that notifications for lower density passing pedestrian traffic have higher visual feature detail levels, and
display the selected notifications on said display.

12. The adaptive pedestrian billboard system of claim 11 wherein the different visual feature detail levels are also based upon different image detail levels.

13. The adaptive pedestrian billboard system of claim 11 wherein said controller further cooperates with said display to change a relative position of advertisements based upon the density of the passing pedestrian traffic.

14. The adaptive pedestrian billboard system of claim 11 wherein the advertisements comprise at least one of video images and static images.

15. The adaptive pedestrian billboard system of claim 11 further comprising at least one speaker collocated with said display and cooperating with said controller for generating audio output for the advertisements; and wherein said controller also changes a volume level of the audio output based upon the density of the passing pedestrian traffic.

16. A method for displaying notifications on a display for passing pedestrian traffic and comprising:

storing a plurality of notifications having different visual feature detail levels in a memory;

determining a density of the passing pedestrian traffic based upon position information collected from mobile wireless communications devices of the pedestrians;

selecting notifications from the memory based upon the density of the passing pedestrian traffic so that notifications for higher density passing pedestrian traffic have lower visual feature detail levels and so that notifications for lower density passing pedestrian traffic have higher visual feature detail levels; and displaying the selected notifications on the display.

17. The method of claim 16 wherein the different visual feature detail levels are based upon different densities of alphanumeric characters.

18. The method of claim 16 wherein the different visual feature detail levels are based upon different sizes of alphanumeric characters.

19. The method of claim 16 wherein the different visual feature detail levels are based upon different image detail levels.

20. The method of claim 16 further comprising changing a relative position of notifications on the display based upon the density of the passing pedestrian traffic.

21. The method of claim 16 further comprising at least one speaker collocated with the display and cooperating with the controller for generating audio output for the notifications; and wherein the controller also changes a volume level of the audio output based upon the density of the passing pedestrian traffic.

* * * * *